US005410824A

United States Patent [19]

Pedersen

[11] Patent Number: 5,410,824

[45] Date of Patent: May 2, 1995

[54] DAPTABLE SNOW SCRAPER

[76] Inventor: Donald A. Pedersen, 6222 Elinor St., Duluth, Minn. 55807

[21] Appl. No.: 161,166

[22] Filed: Dec. 3, 1993

[51] Int. Cl.[6] ..... E01H 5/09

[52] U.S. Cl. ..... 37/242; 37/214; 37/266; 37/241

[58] Field of Search ..... 37/242, 230, 219, 196, 37/205, 206, 214, 243, 244, 266, 285, 284, 278, 265, 434, 270, 271, 272, 231, 253, 241, 403; 172/451

[56] References Cited

U.S. PATENT DOCUMENTS

| | | | |
|---|---|---|---|
| 1,514,248 | 11/1924 | Bergman | 37/241 X |
| 1,708,042 | 4/1929 | Abbe | 37/272 X |
| 2,032,487 | 3/1936 | Lloyd | 37/284 X |
| 2,163,279 | 6/1939 | Henry et al. | 37/231 |
| 2,776,767 | 1/1957 | Stover | 37/231 X |
| 2,997,796 | 8/1961 | Pogue et al. | 37/241 X |
| 3,010,230 | 11/1961 | Zubko | 37/270 |
| 3,164,913 | 1/1965 | Hanson . | |
| 3,230,645 | 1/1966 | Lutz | 37/241 X |
| 3,332,159 | 7/1967 | Dunn . | |
| 3,373,514 | 3/1968 | Forren . | |
| 3,999,316 | 12/1976 | Palmer | 37/242 |
| 4,130,952 | 12/1978 | Dion | 37/403 X |
| 4,245,458 | 1/1981 | Smith | 172/451 X |

OTHER PUBLICATIONS

*Mills Fleet Farm* catalog, 1993, p. 131.

*Primary Examiner*—Randolph A. Reese
*Assistant Examiner*—Victor Batson
*Attorney, Agent, or Firm*—L. Paul Burd; Richard O. Bartz; Robert W. Gutenkauf

[57] ABSTRACT

A scraping implement that can be quickly coupled and uncoupled to a conventional self-propelled snowblower for the removal of snow from a driveway or sidewalk. Drop pins releasably hold the frame of the implement to opposite sides of a snowblower housing. The implement has a concave curved plow mounted on a frame for angle adjustments. A bolt extends through a swivel plate and the frame to hold the plow at the selected position. The frame is laterally adjustable to fit different sized snowblowers.

24 Claims, 3 Drawing Sheets

DAPTABLE SNOW SCRAPER

FIELD OF THE INVENTION

The invention relates to snow removal apparatus having detachable scraping attachments for clearance of sidewalks, driveways and the like.

BACKGROUND OF THE INVENTION

In the northern regions of North America snow falls of 6 inches or less are common. Snowblowers, hand scrapers, brooms, hand shovels, push scoops and the like have been used for the removal of snow. Snowblowers generally take too long and are messy in that wind blown snow is carried back onto the operator and the driveway. Snowblowers also cause small objects such as rocks, to become airborne increasing the risk of bodily injury and property damage. Hand shovels are inefficient for large surface areas and require much time and manual labor to clear snow.

SUMMARY OF THE INVENTION

The invention is directed to a lightweight snow scraper mountable with quick connect bracket units to a walk behind self-propelled snowblower. Use of the snow scraper reduces the time and physical energy for completion of snow removal.

The scraper has a frame having a plate mounted thereto for rotation about an axis vertically disposed relative to the frame. A concave curved plow secured to the plate has a blade for scraping material from a surface. The frame has laterally spaced side members that are located adjacent opposite side of the housing of the snowblower. An end member is slideably mounted on the first and second members to allow lateral adjustment of the frame side members to fit various sized snowblower housings. The quick connect bracket units are mounted on each side of the blower housing. The brackets accommodate the frame side members. Pins are moved through the brackets and the side members to releasably couple the scraper to the snowblower. The plate has a first bore and a second bore circumferentially spaced from the first bore. A pin is extendable through the first bore and the frame to limit rotation of the plate and hold the plow in a first position relative to the frame. The pin can be removed and the plate rotated to move the plow to a second position relative to the frame. The pin then can be inserted through the second bore and the frame to hold the plow in the second position. The plate can have additional bores to hold the plow in other selected positions. In this manner the plow can be easily adjusted between a left angular position, a right angular position, and a center position.

DESCRIPTION OF THE PREFERRED EMBODIMENT

Figure 1:
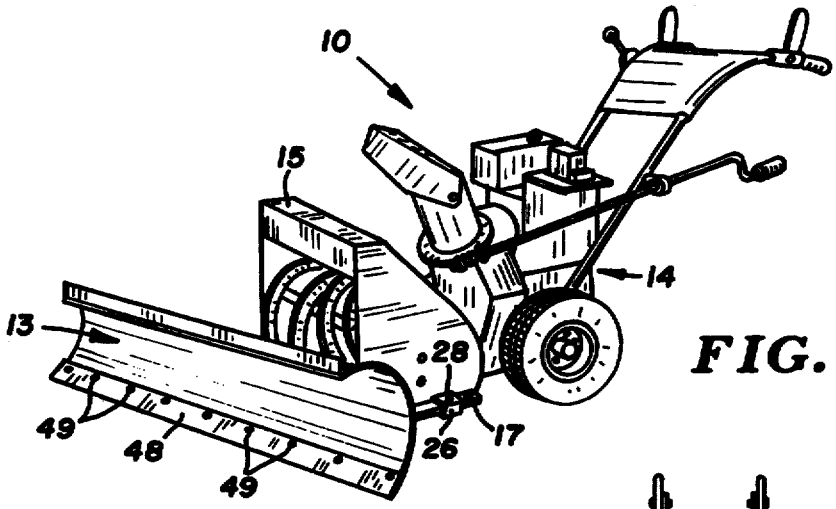
FIG. 1 is a perspective view of a conventional power driven snow blower equipped with the snow scraper of the invention.
Figure 2:
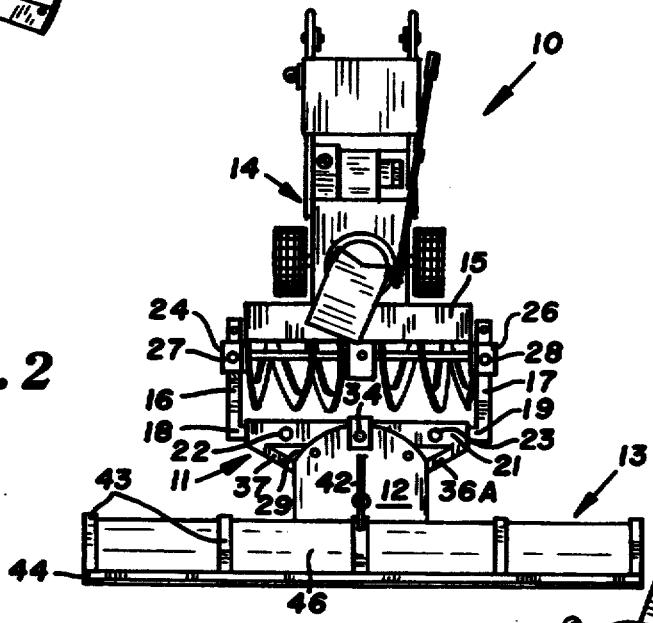
FIG. 2 is a top view of the snow blower and scraper of FIG. 1.
Figure 3:
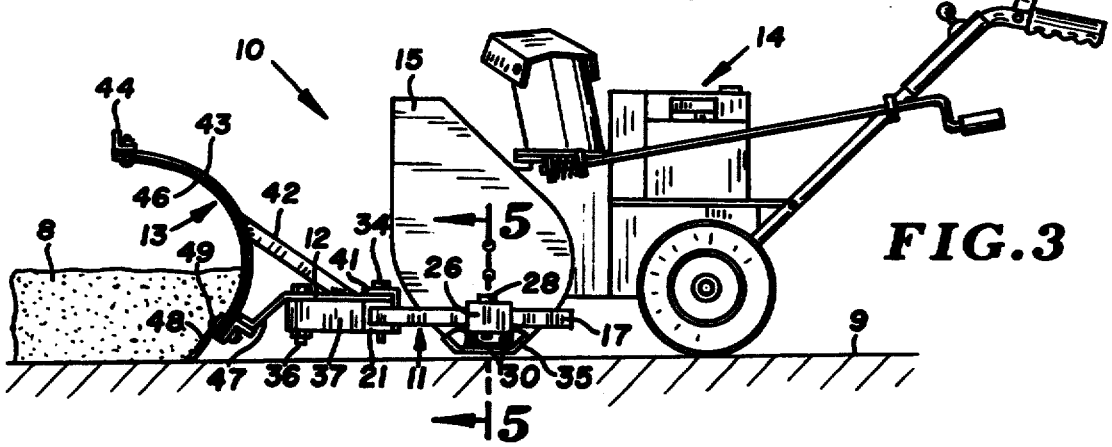
FIG. 3 is a side view of the snow blower and scraper of FIG. 1.

Referring to FIG. 1 to 3, there is shown a snow scraping apparatus of the invention indicated generally at 10 for use in clearing snow-covered surfaces 9, such as driveways and sidewalks. Snow scraping apparatus 10 is mounted on the blower housing 15 of a conventional self-propelled snowblower 14 and operates during forward movement of the snowblower. Apparatus 10, which has two pins 27 and 28 that releasably mount the apparatus on snow blower housing 15, can be quickly mounted or removed from either existing snow blowing machines or new machines.

Apparatus 10 has a wider clearing action than does snowblower 14, whereby time, labor and fuel needed to run the snowblower is conserved. It is easier to keep surfaces clean and thereby decrease build up of ice and packed snow on walking surfaces. Also, snow is not blown back at the operator or onto the cleared surface when scraping apparatus 10 is used in windy conditions. Potentially injurious objects, such as small stones or rocks, do not fly from apparatus 10 during use thereof increasing operator and bystander safety.

The snow scraping apparatus 10 comprises generally a frame 11, swivel plate 12 pivotally mounted on frame 11 and a plow 13 connected to plate 12 for deflecting and cleaning snow 8 from a snow-covered driveway 9, sidewalk and the like. Apparatus 10 can also be used for cleaning small amounts of debris from blacktop, cement or wood surfaces. Frame 11 is adapted for mounting on a conventional self-propelled snowblower 14. Frame 11 is also adaptable for mounting on other types of self-propelled machines.

Figure 8:
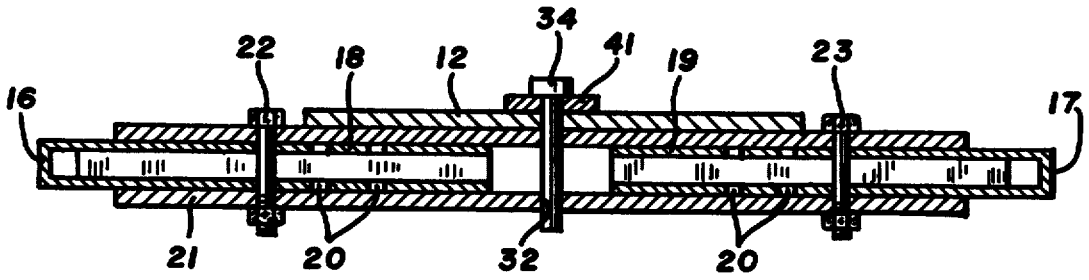
FIG. 8 is an enlarged transverse sectional view taken along line 8—8 of FIG. 6.

Frame 11 is generally U-shaped with parallel side members 16 and 17 of channel cross section having inwardly directed legs 18 and 19 telescoped into opposite ends of a channel-shaped end member 21. As shown in FIG. 8, bolts 22 and 23 extend through the vertical holes in end member 21 and holes in legs 18 and 19 to hold side members 16 and 17 in assembled relation with member 21. Members 18 and 19 have additional holes 20 to permit lateral adjustment of side members 16 and 17 to accommodate different sized snow blower housings.

Figure 4:
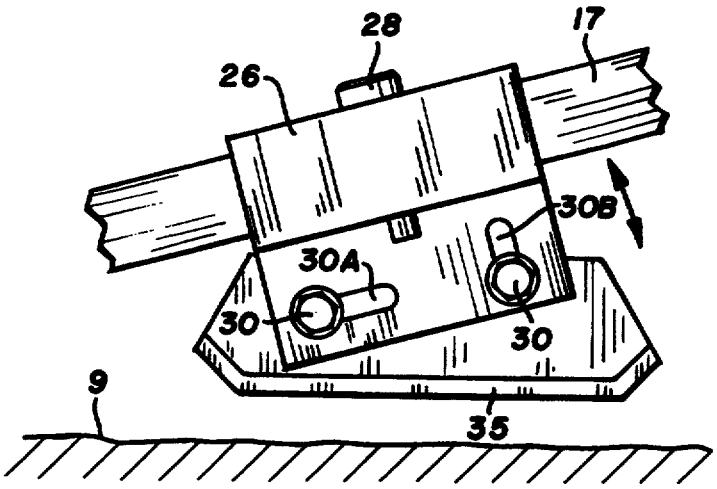
FIG. 4 is an enlarged side elevational view of the quick connect bracket unit shown in FIG. 3.

To adapt frame 11 for connection to a conventional blower housing 15 of a snowblower 14, side members 16 and 17 of frame 11 extend rearwardly and telescope through quick connect mounting brackets 24 and 26 secured to the bottom side edges of blower housing 15 with the original fasteners 30 that connect the existing skid plates 35 of snowblower 14 to blower housing 15. As shown in FIG. 4, bracket 26 has a horizontal slot 30A and a vertical slot 30B accommodating fasteners 30, shown as bolts. The slots 30A and 30B allow angular adjustment of bracket 26 on the side of blower housing 15. This adjustment spaces skid shoes 35 above the surface 9 so that scraper blade 48 can be retained in engagement with surface 9. The weight of the snow blower forward of the wheels is transmitted via scraper blade 48 to surface 9. The operator can bear down on the handle of the snow blower to lift blade 48 above surface 9.

Figure 5:
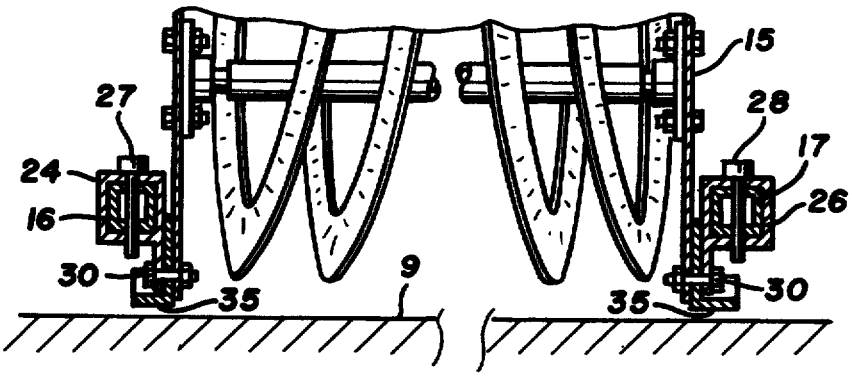
FIG. 5 is a sectional view taken along the line 5—5 of FIG. 3 showing the quick connect bracket units on opposite sides of the blower housing.

End member 21 extends transversely across the front of blower housing 15. As shown in FIG. 5, pins 27 and 28 extend through vertically aligned holes in mounting brackets 24 and 26 and vertically aligned holes in side members 16 and 17 to releasably couple frame 11 to opposite sides of blower housing 15. Bolts 22 and 23 can be loosened and removed from member 21 to allow lateral adjustment of side members 16 and 17 relative to end member 21 to fit larger and smaller sized snowblower housings.

Figure 6:
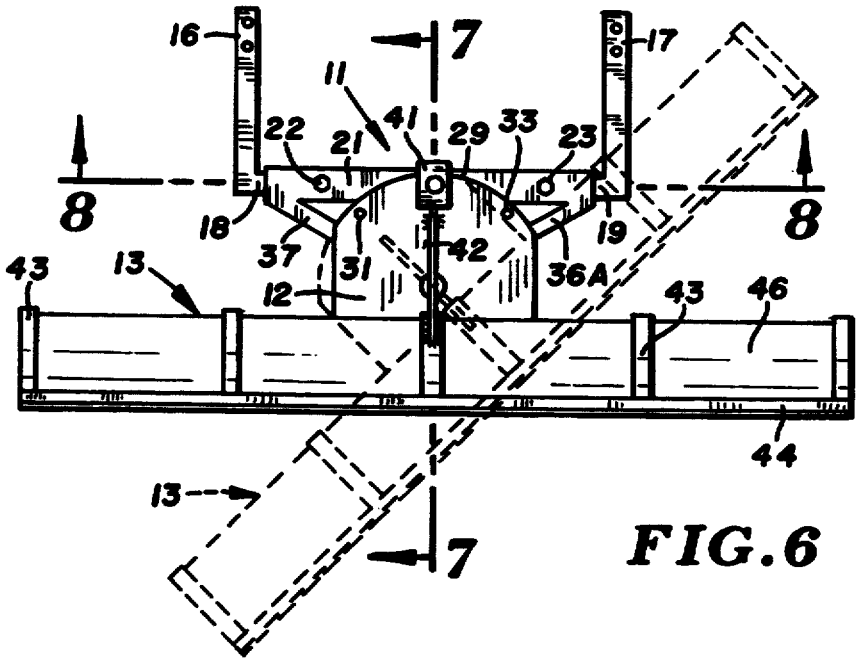
FIG. 6 is a top view of scraper unit.

Referring to FIG. 6, swivel plate 12 is mounted on frame 11 to rotate about an axis perpendicular to side members 16 and 17 which extend longitudinally toward snowblower 14. Plate 12 has a generally rectangular shape having a forward linear end 47 connected to plow 13 and a rear convex-curved end 29 adjacent snowblower 14.

Plate 12 has a plurality of holes 31, 32 and 33 equally spaced along end 29. A pin 34 is inserted through one of holes 31–33 and frame 11 to hold plow 13 at a desired angular or parallel relation with respect to snowblower 14. Plate 12 can be provided with additional holes (not shown) to increase the range of angular positions of plow 13 relative to the snowblower. As shown in FIG. 2, pin 34 extends through hole 32 to hold the plow 13 at a middle position generally parallel to the front of blower housing 15. Plate 12 has a center hole receiving a pivot fastener or king pin, such as bolt and nut assembly 36, to pivotally connect plate 12 to a pair of inwardly converging arms 36A and 37 of frame end member 21. End 29 of plate 12 is located between the outwardly directed end of a yoke 41 secured to frame end member 21 and extended over the top surface of frame end member 21. Pin 34 is moved through vertically aligned holes in yoke 41 and in end member 21 and through bore 32 in plate end 29 to hold plow 13 at the middle position.

Figure 7:
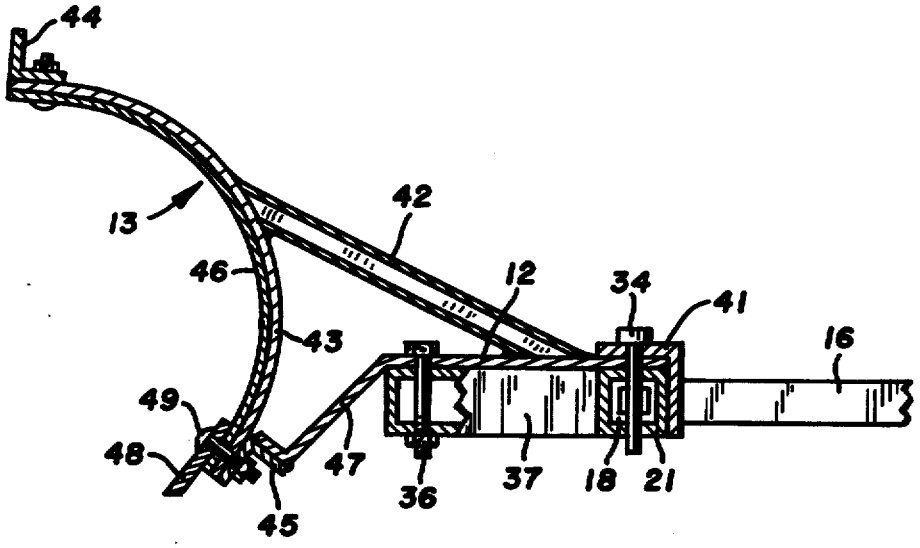
FIG. 7 is a longitudinal sectional view taken along the line 7—7 of FIG. 6.

Plow 13 is curved inwardly from top to bottom and generally rectangular having a lower linear edge or scraper blade 48. As shown in FIGS. 1 and 7, a scraper or replaceable wear blade 48 is attached to the lower end of plow 13 with a plurality of laterally spaced fasteners 49. The length of plow 13 is approximately twice the width of blower housing 15. Plow 13 can have longer or shorter lengths. As shown in FIG. 7, plow 13 has a frame comprising an upper angle member 44 and a lower angle member 45 connected to a plurality of laterally spaced concave curved ribs 43. A curved sheet metal member 46 is secured to the forward sides of ribs 43 and angle members 44 and 45. A brace 42 connected to the center of rib 43 inclines downwardly to plate 12 and is secured thereto.

As shown in FIG. 7, plate 12 has a downwardly inclined forward end 47 secured with welds to angle member 45. Fasteners 49, shown as nut and bolt assemblies, connect blade 48 to the front of plow 13. Fasteners 49 extend through aligned holes in blade 48, sheet member 46, ribs 43 and angle member 45. Angle member 45 being connected to end 47 of plate 12 connects plate 12 to plow 13. Brace 42 extends from the top of plate 12 to plow rib 43 to provide additional support to plow 13 and solidify the connection between plow 13 and plate 12.

In use, snow scraping apparatus 10 is mounted onto a self-propelled snowblower 14 for removal of snow 8 from a snow covered surface 9, such as a driveway. Referring to FIG. 5, fasteners 30 holding the snowblower skid shoes or plates 35 to the bottom side edges of blower housing 15 are removed. Mounting brackets 24 and 26 are then positioned adjacent skid plates 35 and connected to the blower housing 15 with the fasteners 30. Brackets 24 and 26 are angularly fastened to opposite sides of snowblower housing 15 to space shoes 35 above the surface 9 so that scraper blade 48 bears against surface 9 and is retained in engagement with surface 9 with the weight of the snowblower. Snowblower 14 is maneuvered to the back of apparatus 10 to position the side members 16 and 17 of frame 11 in alignment with brackets 24 and 26. Snowblower 14 is moved forwardly whereby side members 16 and 17 extend rearwardly and telescope through the brackets 24 and 26. Members 16 and 17 are positioned in brackets 24 and 26 to align the holes in members 16 and 17 with the holes in the brackets. Pins 27 and 28 are dropped through the vertically aligned holes in brackets 24 and 26 and frame side members 16 and 17 to releasable couple scraping apparatus 10 to snowblower 14.

Frame 11 can be adjusted to fit snowblower housings having different lateral widths than snowblower housing 15. Referring to FIG. 8, bolts 22 and 23 are removed from member 21 and legs 18 and 19. Legs 18 and 19 can then be laterally moved within frame end member 21 to adjust the lateral distance between frame side members 16 and 17 to be slightly wider than the lateral width of blower housing 15 whereby side members 16 and 17 can be telescopically received by mounted brackets 24 and 26 secured to opposite sides of housing 15. Bolts 22 and 23 are replaced on member 21 and legs 18 and 19 thereby holding side members 16 and 17 in assembled relation at the adjusted lateral positions.

When scraping apparatus 10 is coupled to snowblower 14, plow 13 can be used to push snow 8 and other debris from the surface to be cleaned as the snowblower is driven forwardly. As shown by broken lines in FIG. 6, plow 13 can be adjusted from a middle position to a left angular position relative to the front of snowblower 14 so that snow can be pushed toward one side of the surface being cleared. The angular adjustment of plow 13 is made by removing pin 34 from plate 12, yoke 41 and frame end member 21. Plate 12 and plow 13 can then be pivoted about bolt and nut assembly 36 so that plow blade 48 angles inwardly from the right end of the blade to the left end thereof and the front of plow 13 faces one side of the surface to be cleared. Plate 12 and plow 13 are pivoted to the left by manually swinging the right end of the plow away from frame 11 or pulling the left end toward frame 11. Alternatively, snowblower 14 can be pulled rearwardly and to the left, moving frame side member 17 toward plow 13 and frame side member 16 away from the plow. The convex-curved shape of plate end 29 allows plate 12 to rotate between yoke 41 and frame 11. Plate 12 and plow 13 are pivoted to move bore 33 in vertical alignment with the vertically aligned holes in yoke 41 and frame end member 21. Pin 34 is then moved through yoke 41 and bore 33 in plate end 29 and through the aligned holes in end member 21 to hold plow 13 at the left angular position.

Plow 13 can be adjusted to a right angular position relative to the front of snowblower 14 in a similar manner. Pin 34 is removed from plate 12, frame member 21 and yoke 41 to allow the plate 12 and plow 13 to be pivoted about bolt and nut assembly 36 so that blade 48 angles inwardly from the left end to the right end of the blade. Bore 31 in plate 12 is moved into vertical alignment with the vertically aligned holes in yoke 41 and frame end member 21. Pin 34 is then moved back through yoke 41, bore 32 and end member 21 to hold plow 13 at the right angular position.

While there has been shown and described a preferred embodiment of the snow scraping apparatus according to the present invention, it is understood that changes in structure, materials and design can be made by persons skilled in the art without departing from the substance of the invention. The invention is defined in the following claims.

I claim:

1. A material scraping apparatus for removing material from a surface comprising: a snowblower, the snowblower having a housing with a first upright wall, and a second upright wall transversely spaced from the first upright wall, skid plates located adjacent said upright walls, fastener means extended through the walls coupling the skid plates to the housing, a frame mounted on the housing, the frame including laterally adjustable means to fit different sized snowblower housings, a plate mounted on the frame for rotation about an axis vertically disposed relative to the frame, a plow secured to the plate and having a blade for scraping material from a surface, means co-operating with the frame and plate to limit rotation of the plate and hold the plow in a selected position relative to the frame, and coupling means mounted on the first and second upright walls of the housing with the fastening means and operable to releasably couple the frame to the housing and hold the skid plates above the surface when the blade scrapes material from the surface whereby the blade is maintained in engagement with the surface.

2. The apparatus of claim 1 wherein: the laterally adjustable means comprises laterally spaced first and second side members located adjacent the first and second walls of the housing, and an end member joining the first side member to the second side member, the first and second side members slideably mounted on the end member for lateral adjustment of the side members relative to the end member, and means for holding the side members on the end member in adjusted positions on the end member.

3. The apparatus of claim 1 wherein: the frame has a first side member and a second side member laterally spaced from the first side member, the first and second side members accommodated by the coupling means to releasably connect the frame to the machine.

4. The apparatus of claim 1 wherein: the coupling means comprises a first bracket mounted on the first upright wail of the housing, a second bracket mounted on the second upright wall of the housing, the frame having side members extending longitudinally into the brackets, and pin means extended through the brackets and side members to couple the frame to the housing.

5. The apparatus of claim 4 wherein: the pin means are slideably removable from the brackets and side members to uncouple the frame from the machine.

6. The apparatus of claim 1 wherein: the plate is rotatable to move the plow between first and second angular positions and a center position.

7. The apparatus of claim 1 wherein: the plate has at least one hole radially spaced from the axis, the means co-operating with the frame and plate comprising a pin slideably extended through the hole and frame to hold the plow in the selected position.

8. The apparatus of claim 1 wherein: the plate has a first hole and a second hole circumferentially spaced from the first hole, the means co-operating with the frame and plate comprising a pin slideably extendable through the first hole and the frame to hold the plow in a first position and slideably extendable through the second hole and the frame to hold the plow in a second position.

9. The apparatus of claim 1 wherein: the plow has a generally concave curved shape.

10. A snow scraping apparatus comprising: a self-propelled snowblower machine, the snowblower machine having a housing with a pair of upright side walls, each side wall having a lower edge, a shoe member located adjacent the lower edge, fastening means coupling the shoe members to the side walls, a frame mounted on the housing and having laterally spaced first and second side members located adjacent the side walls of the housing, an end member slideably mounted on the first and second side members allowing lateral adjustment of the side members relative to the end member, a plate mounted on the frame for rotation about an axis vertically disposed relative to the frame, a plow secured to the plate and having a blade for scraping material from a surface, means co-operating with the frame and plate to releaseably hold the plow in a selected position relative to the frame, and coupling means mounted on the housing with the fastening means and accommodating the first and second side members to releasably couple the frame to the housing and hold the shoe members above the surface when the blade scrapes material from the surface whereby the blade is maintained in engagement with the surface.

11. The apparatus of claim 10 wherein: the plate is rotatable to move the plow between first and second angular positions and a center position.

12. The apparatus of claim 11 wherein: the plow has a generally concave curved shape.

13. The apparatus of claim 10 wherein: the plate has at least one bore radially spaced from the axis, the means co-operating with the frame and plate comprising a pin slideably extended through the bore and frame to hold the plow in the selected position.

14. The apparatus of claim 10 wherein: the plate has a first hole and a second hole circumferentially spaced from the first hole, the means co-operating with the frame and plate comprising a pin slideably extendable through the first hole and the frame to hold the plow in a first position relative to the frame and slideably extendable through the second hole and the frame to hold the plow in a second position relative to the frame.

15. The apparatus of claim 10 wherein: the coupling means comprises a first bracket mounted on one side wall of the housing with the fastening means, a second bracket mounted on the opposite side wall of the housing with the fastening means, the side members extending longitudinally into the brackets, and pin means extended through the brackets and side members to couple the frame to the housing.

16. The apparatus of claim 15 wherein: the pin means are slideably removable from the brackets and side members to uncouple the frame from the snowblower.

17. A snow scraping apparatus comprising: a self-propelled snowblower, the snowblower having a housing with side walls, skid means connected to the side walls, a frame mounted on the housing, a plate mounted on the frame for rotation about an axis vertically disposed relative to the frame, the plate having a first hole and a second hole circumferentially spaced from the first hole, a plow secured to the plate, said plow having a blade for scraping snow from a snow covered surface, a pin slideably extendable through the first hole and the frame to hold the plow in a first position and slideably extendable through the second hole and the frame to hold the plow in a second position, coupling means mounted on the sidewalls of the housing operable to releasably couple and uncouple the frame to and from the housing and hold the skid means above the surface when the blade scrapes snow from the surface whereby the blade is maintained in engagement with the surface, and means releasably connecting the frame to the coupling means.

18. The apparatus of claim 17 wherein: the frame includes laterally adjustable means to fit different sized self-propelled snowblower housings.

19. The apparatus of claim 17 wherein: the frame has laterally spaced first and second side members located adjacent the side walls of the housing, and an end member joining the first side member to the second side member, the first and second side members slideably mounted on the end member for lateral adjustment of the side members relative to the end member.

20. The apparatus of claim 17 wherein: the frame has a first side member and a second side member laterally spaced from the first side member, the first and second side members accommodated by the coupling means to releasably connect the frame to the snowblower.

21. The apparatus of claim 17 wherein: the coupling means comprises a first bracket mounted on one side wall of the housing with the first fastener, and a second bracket mounted on the opposite side wall of the housing with the second fastener, the frame having side members extending longitudinally into the brackets, and pin means extended through the brackets and side members to couple the frame to the housing.

22. The apparatus of claim 21 wherein: the pin means are slideably removable from the brackets and side members to uncouple the frame from the snowblower.

23. The apparatus of claim 17 wherein: the plate is rotatable to move the plow between the first and second positions and a center position.

24. The apparatus of claim 17 wherein: the plow has a generally concave curved shape.

* * * * *